US005941058A

United States Patent [19]

Wassenhoven et al.

[11] Patent Number: 5,941,058

[45] Date of Patent: Aug. 24, 1999

[54] SLIVER OPENING DEVICE

[75] Inventors: Heinz-Georg Wassenhoven; Jochen Dressen, both of Mönchengladbach; Dieter Haaken, Erkelenz, all of Germany

[73] Assignee: W. Schlafhorst AG & Co., Moenchengladbach, Germany

[21] Appl. No.: 09/049,608

[22] Filed: Mar. 27, 1998

[30] Foreign Application Priority Data

Mar. 27, 1997 [DE] Germany ..... 197 12 880

[51] Int. Cl.[6] ..... D01H 4/00

[52] U.S. Cl. ..... 57/408; 57/406

[58] Field of Search ..... 57/404, 406, 407, 57/408

[56] References Cited

U.S. PATENT DOCUMENTS

| | | | |
|---|---|---|---|
| Re. 33,190 | 4/1990 | Stahlecker | 57/408 |
| 5,085,047 | 2/1992 | Hofmann | 57/408 |
| 5,465,567 | 11/1995 | Schmolke et al. | 57/408 |
| 5,709,074 | 1/1998 | Stahlecker | 57/408 |
| 5,850,730 | 12/1998 | Wassenhoven et al. | 57/408 |

FOREIGN PATENT DOCUMENTS

| | | | |
|---|---|---|---|
| AS 23 29 223 | 5/1978 | Germany . | |
| 41 21 387 A1 | 1/1993 | Germany . | |
| 38 14 514 C2 | 9/1995 | Germany . | |
| 680802 | 11/1992 | Switzerland | 57/408 |

*Primary Examiner*—William Stryjewski

*Attorney, Agent, or Firm*—Kennedy Covington Lobdell & Hickman LLP

[57] ABSTRACT

A sliver opening device for an open-end spinning unit (1) with an opening cylinder (21) which rotates in an opening-cylinder housing (17) and comprises a base (29) arranged on a bearing shaft (26) with a replaceable annulus (30) of card-clothing fitted onto the base (29). The annulus (30) is held between an abutment flange (31) of the base (29) and a cover disk (33) of an enlarged diameter. The housing (17) and the cover disk (33) have mating stepped regions (45) at their outer circumferences to enclose and generally seal the housing. A visor-like shield (50) is arranged at a distance in front of the cover disk (33) to protect the cover disk from being touched inadvertently.

9 Claims, 3 Drawing Sheets

SLIVER OPENING DEVICE

BACKGROUND OF THE DISCLOSURE

The present invention relates generally to sliver opening devices and, more particularly, to means for enclosing the opening cylinder within the housing of the device.

Such sliver opening devices, which are described in numerous publications, especially in conjunction with open-end rotor spinning machines, have long been known and have proven themselves in practice.

For example, German Patent Publication DE 38 14 514 C2 describes a sliver opening device with an opening cylinder fixed via its bearing shaft in a bearing bracket of a spinning box housing. A roller bearing and a base which is surrounded by a replaceable annulus of opening elements (e.g., card clothing or the like) are arranged on the bearing shaft. The annulus is fixed between an axially movable cover disk and an abutment flange of the base. The cover disk is biased axially via a screw bolt which acts on an intercalated spring element.

During the spinning process the opening cylinder and the annulus rotate as a unit in an interior recessed area of an opening-cylinder housing and thereby function to open a supplied sliver into individual fibers. The individualized fibers are then fed to a spinning rotor rotating at a high speed in a rotor housing. The rotating opening cylinder is covered at its front (outward) side by a safety plate fixed on the opening-cylinder housing which plate prevents operating personnel from being able to inadvertently touch the frontal cover disk of the rotating opening cylinder and injure themselves thereby.

Even though the known sliver opening devices in principle have proven themselves in practice, their structural components have a few disadvantages, e.g. a relatively great susceptibility to form fly or fluff from the opening of the sliver.

For example, the problem can occur in the known sliver opening devices that fiber fly collects during the spinning process between the safety plate arranged stationarily on the opening-cylinder housing and between the rotating cover disk. This fiber fly can build up in the further course of the spinning process to a rather large fiber clump and then result in considerable disturbances, e.g. blocking the opening cylinder. Specifically, the fiber fly, which is unavoidable in spinning mills, is sucked into the opening-cylinder housing due to the vacuum therein and settles generally between the stationary safety plate and the rotating cover disk.

German Patent Publication DE-AS 23 29 223 teaches a sliver opening device in which the amount of infiltrated secondary air flowing in through a circulation slot into the opening-cylinder housing is to be limited by a sealing arrangement between a rim edge of the opening cylinder and the wall of the opening-cylinder housing to a value which takes into account certain technological requirements as well as the expenditure of energy. Among other things, a stepped, labyrinth-like seal is described as a possible embodiment for such a sealing arrangement. The sealing arrangement is located on the back side of an opening-cylinder housing closed in a hood-like manner on the front.

However, there is the danger in the case of opening-cylinder housings designed in this manner that combed-out individual fibers get in the area between the closed front wall of the opening-cylinder housing and the flanged wheel of the opening cylinder and become compressed therein over the passage of time. This process can result subsequently in considerable disturbances in normal operation of the device, but is generally noticeable too late from the outside, whereby these known sliver opening devices have not been accepted in practice.

Moreover, German Patent Publication DE 41 21 387 A1 teaches a support disk bearing for open-end spinning apparatus in which the outward sides of the support disks are aerodynamically improved. That is, convexly curved covers are arranged on the side surfaces of these support disks to reduce the air vortices in the area of the rotating side surfaces of the support disks during operation. A measurable lowering of the energy consumption during the operation of such support disk bearings was able to be achieved with these aerodynamically improved support disks.

SUMMARY OF THE INVENTION

In view of the state of the art cited above, the present invention has the object of creating an improved sliver opening device which addresses the problems of the known devices.

The present invention addresses this objective by providing a sliver opening device for an open-end spinning apparatus which basically comprises a housing with an opening cylinder rotatably disposed in the housing. The opening cylinder has a bearing shaft, a base with an abutment flange arranged on the bearing shaft, a replaceable annulus of sliver opening elements fitted peripherally to the base against the abutment flange, and a cover disk mounted to the base opposite the abutment flange with the annulus therebetween. The cover disk has a diameter greater than the diameter of the annulus and the cover disk and the housing have respective mating stepped regions to generally seal the housing. A shield is movably mounted to the housing at a distance from the cover disk, with the housing having a releasable catch means for fixing the shield in an operating position.

This design of the cover disk in accordance with the invention in combination with the arrangement of the shield has the advantage that the flow of infiltrated air present in this area can be reduced in a simple manner and with a justifiable manufacturing cost to a technologically harmless degree and, thus, the susceptibility of the sliver opening device to the formation of fly can be distinctly decreased therewith. At the same time the spaced arrangement of the shield assures that even after rather long periods of operation any fiber fly collecting between the rotating cover disk and the stationary safety device will not have a negative influence on the operation of the device.

The accumulation of dust and fiber fly on the cover disk is also reliably prevented by the advantageous design of the cover disk with a smooth convex outward surface which results in an optimization of the flow conditions in this area. That is, the absence of any structure on the outward side of the cover disk assures that no dust or fiber fly can accumulate thereon which could result in disturbances in the spinning process. In addition, the airflow conditions are optimized, which results in a reduction of the energy consumption of the opening-cylinder drive.

A central recess for receiving a fastening means is preferably arranged in the cover disk. The recess is closed by a cap whose outward side is convexly curved in conformity with the outward side of the cover disk so that the overall outward side of the rotating structural element is configured for optimal air flow at all points thereabout.

The cap can be fixed on the cover disk in a preferred embodiment via a positive fastening device. Such a positive fastening consists preferably of nose-like extensions on the cap as well as of a circumferential groove in the area of the recess within the cover disk. This arrangement assures a reliable securement of the cap during the spinning operation while, on the other hand, the cap can also be readily dismounted when necessary for access to the centrally arranged fastening means for the cover disk, e.g. if it should be necessary to replace fittings. The cap is advantageously designed as an injection-molding part or die-casting part whereby such structural elements can be manufactured preferably from plastic or aluminum relatively economically and with a sufficient fit, especially if rather large quantities are required.

The cap preferably has an indicating groove or other appropriate means which makes it possible to recognize unambiguously the operating state of the opening cylinder. Thus, operating personnel can see without a doubt from the indicating means whether the opening cylinder is rotating or whether the opening cylinder is standing still. This feature makes it possible to avoid with a high degree of safety injuries arising from an unintended touching of an opening cylinder which is assumed to be standing but in reality is still rotating.

The cap preferably comprises a central bore which makes it possible to use a suitable tool so that the cover can be readily removed from the recess if necessary even though the front surface of the cap merges flush into the front surface of the cover disk and thus would not otherwise be accessible to a tool.

Further details, features and advantages of the invention will be described and understood from an exemplary embodiment set forth below with reference to the accompanying drawings.

DESCRIPTION OF THE PREFERRED EMBODIMENT

Figure 1:
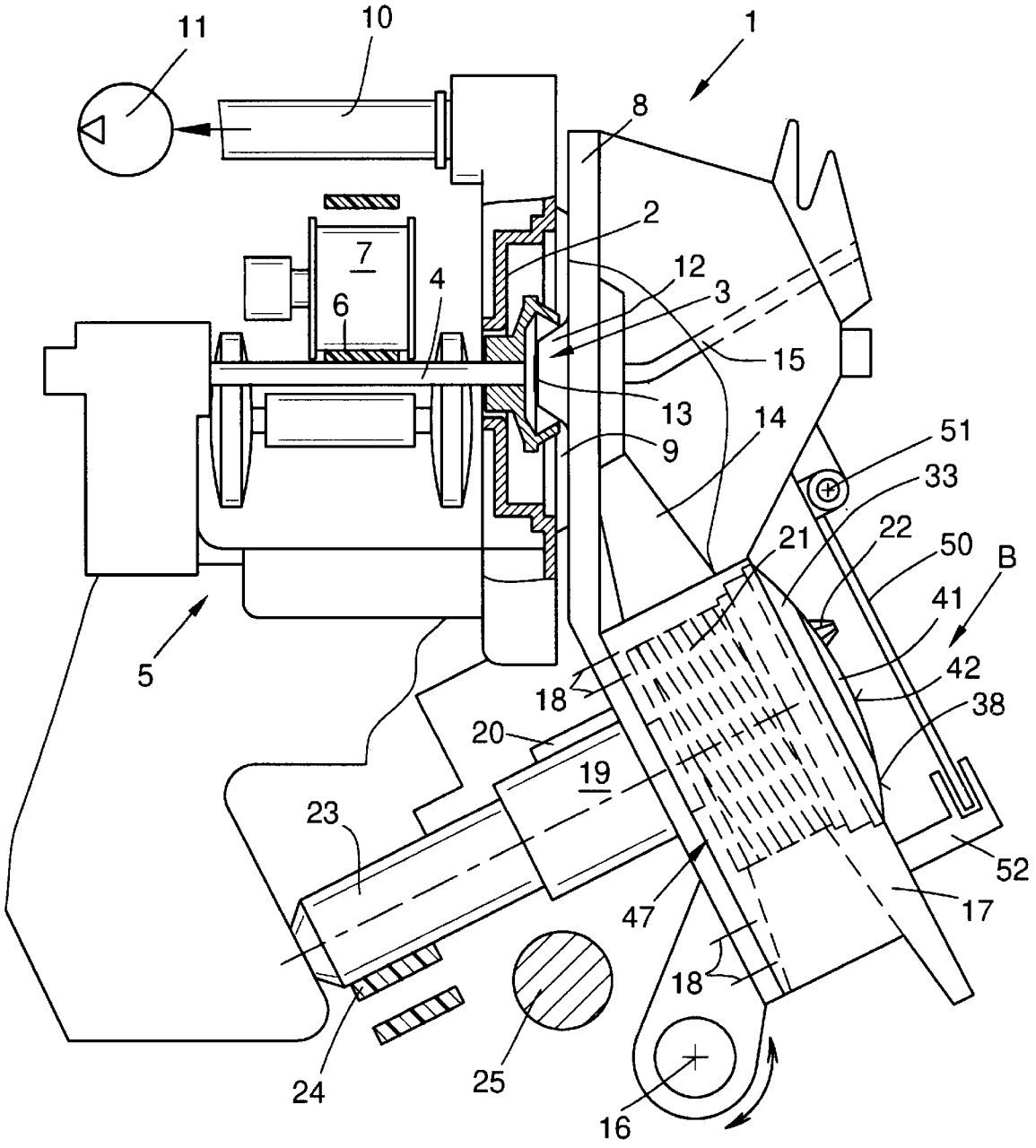
FIG. 1 is a side elevational view, partially in cross-section, of an open-end spinning apparatus with a sliver opening device in accordance with a preferred embodiment of the present invention.

Referring now to the accompanying drawings, an open-end spinning apparatus is shown in FIG. 1 and is designated in its entirety by reference numeral 1. The open-end spinning apparatus basically comprises, as is known, a spinning device as well as of a sliver opening device.

The spinning device comprises spinning rotor 3 rotating in rotor housing 2 at a high speed. Spinning rotor 3 is supported by its rotor shaft 4 in the nip of support disk bearing 5 and is driven by tangential belt 6 which runs the length of the machine and is maintained in engagement with the shaft 4 by backup roller 7. Rotor housing 2, which is open to the front of the apparatus, is closed during the spinning operation by pivotably mounted cover element 8 with a seal 9 and/or by a conduit plate (not shown in more detail) arranged on cover element 8. A so-called conduit plate adapter 12 is replaceably mounted to the conduit plate as an extension into the rotor 3 and comprises yam withdrawal nozzle 13 as well as the mouth area of fiber guide conduit 14. Yarn withdrawal tube 15 is connected to yarn withdrawal nozzle 13. In addition, rotor housing 2 is connected, as is customary, via an appropriate suction line 10 to vacuum source 11 which produces a spinning vacuum necessary in rotor housing 2.

A sliver opening device is also integrated into cover element 8. The sliver opening device comprises an opening-cylinder housing 17 fixed, e.g. via screw bolts 18, on cover element 8, which is mounted so that it can pivot in a limited manner about pivot axis 16. In addition, cover element 8 has rear bearing brackets 19, 20 for supporting bearing shaft 26 of opening cylinder 21 and for supporting sliver drawing-in cylinder 22.

Opening cylinder 31 is driven from its shaft 23 by tangential belt 24 running the length of the machine. The sliver drawing-in cylinder 22 is preferably driven via a worm gear arrangement (not shown) connected to drive shaft 25 running the length of the machine.

Figure 2:
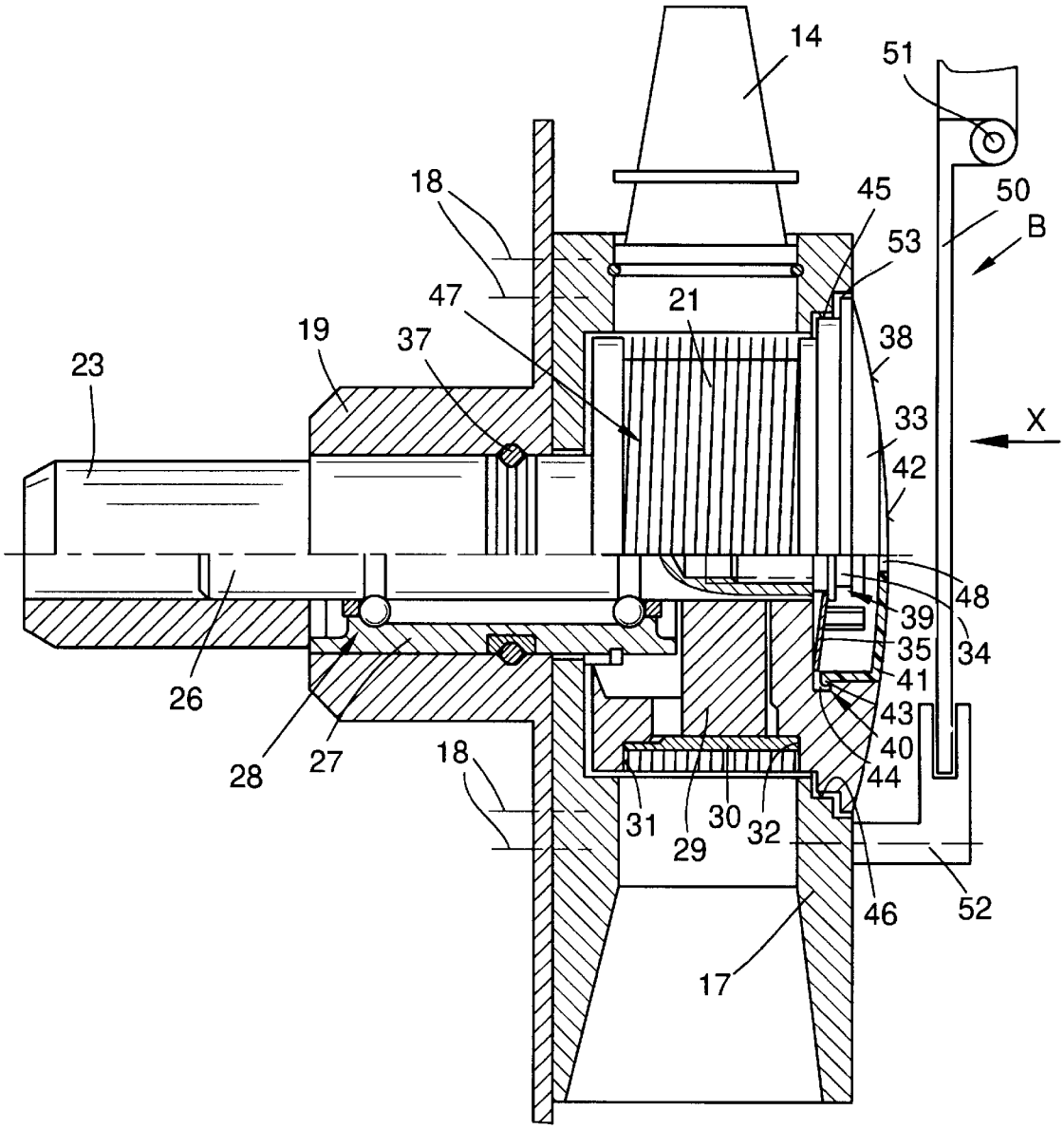
FIG. 2 is a more enlarged side elevational view, also partially in cross-section, of the sliver opening device of the open-end spinning apparatus of FIG. 1.

FIG. 2 shows opening cylinder assembly 21 of the sliver opening device in detail. The opening cylinder assembly 21 rotates in opening-cylinder housing 17 and has a bearing shaft 26 carrying a roller-bearing arrangement 28 and a base 29 fixed to one end of the shaft 26. Roller-bearing arrangement 28 is mounted by bearing housing 27 in bearing flange 19 of cover element 8 of open-end spinning apparatus 1 and is fixed therein by a suitable catch means 37.

Annulus 30 comprised of sliver opening teeth or like opening elements, e.g. card clothing, is fitted onto base 29 against abutment flange 31 of base 29 and held in place by contact shoulder 32 of a cover disk 33 secured to the outward end of the shaft 26. In the exemplary embodiment shown, cover disk 33 can shift axially on bearing shaft 26 against the biasing force of a yieldable fastening means, e.g. screw bolt 34 acting on disk spring 35. Of course, other types of fastening means are also suitable for fastening cover disk 33 to bearing shaft 26.

Cover disk 33 thereby revolves with opening cylinder 21 as a unit and has a convexly curved outward side 38 into which central recess 39 is formed. Cap 41 is positively fixed in central recess 39 by fastening device 40. Cap 41 has an outward side 42 which is convexly curved in conformity with outward side 38 of cover disk 33 so that a flow-optimized rotary body is produced.

Figure 3:
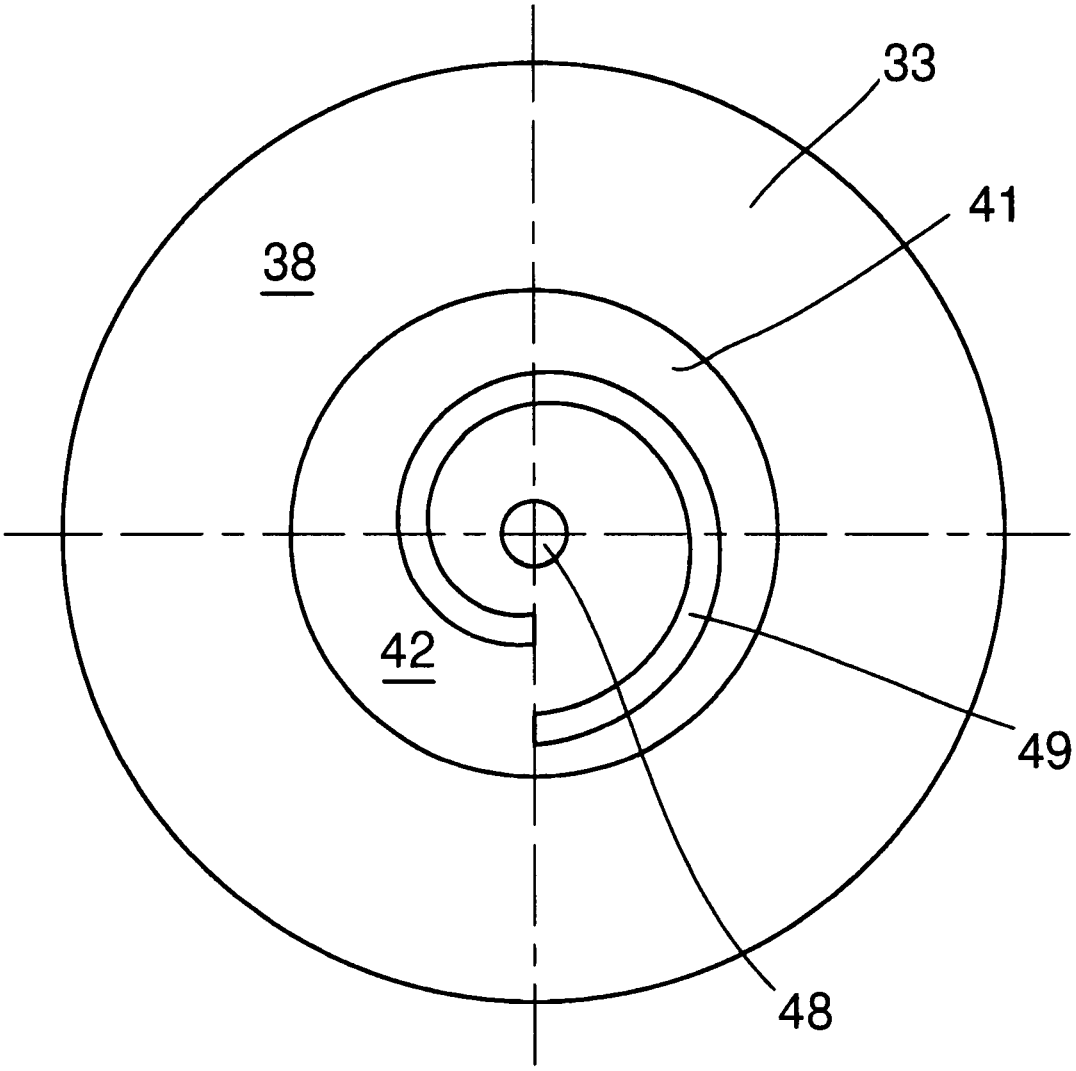
FIG. 3 is a front elevational view of the cover disk of the opening cylinder of the present sliver opening device as viewed along the arrow X in FIG. 2.

Fastening device 40 preferably consists of nose-like extensions 43 on cap 41 as well as circumferential groove 44 in recess 39. Moreover, cap 41 has a central bore 48 which makes it possible to insert an appropriate tool so that cap 41 can be readily dismounted if necessary. An indicating groove 49 (see FIG. 3) on cap 41 makes the particular operating state of opening cylinder recognizable in an unambiguous manner.

Cover disk 33, whose diameter is distinctly greater than the diameter of annulus 30, has graduated sealing steps 45 formed annularly in the area of its outer circumference which mate with correspondingly formed graduated sealing steps 46 on opening-cylinder carrier 47 of opening-cylinder housing 17. The relatively narrow axial circulation slots of this stepped sealing arrangement 45/46 result in a minimizing of the entry of infiltrated air into opening-cylinder housing 17.

Even though the operating state of opening cylinder 21 is already rendered recognizable by the indicating groove 49 in an unambiguous manner, rotatable cover disk 33 is also covered for safety reasons by shield 50 arranged at a spacing relative to cover disk 33. This shield 50 is mounted on cover element 8 in such a manner that it can pivot about pivot axis 51 and can be fixed by catch lever 52 in operating position B shown in FIGS. 1 and 2.

The design of the cover disk in accordance with the invention, in combination with the arrangement of the shield, results in a distinct improvement of the sliver opening devices, especially as regards the susceptibility of such devices to fly formation. The arrangement of shield 50 at a distance from cover disk 33 protects the area between opening cylinder—cover disk and safety cap, which area is especially critical as regards the accumulation of fiber fly. In addition, the flow-optimized design of the outward side of cover disk 33 serves to lower the drive energy necessary for operating the fiber opening device.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed:

1. A sliver opening device for an open-end spinning apparatus comprising: a housing;

an opening cylinder rotatably disposed in the housing, the opening cylinder comprising a bearing shaft, a base arranged on the bearing shaft, the base having an abutment flange, a replaceable annulus of sliver opening elements fitted peripherally to the base against the abutment flange, and a cover disk mounted to the base opposite the abutment flange with the annulus therebetween, the cover disk having a diameter greater than the diameter of the annulus;

the cover disk and the housing having respective mating stepped regions to generally seal the housing; and a shield movably mounted to the housing at a distance from the cover disk, the housing having a releasable catch means for fixing the shield in an operating position.

2. The sliver opening device according to claim 1, wherein the cover disk has a smooth convexly curved outward side.

3. The sliver opening device according to claim 2, wherein the outward side of the cover disk has a central recess for receiving a fastening means for securing the cover disk to the base, the cover disk including a cap fitted within the recess and having an outward side curved convexly in correspondence to the cover disk.

4. The sliver opening device according to claim 3, further comprising a fastening device for securing the cap within the recess.

5. The sliver opening device according to claim 4, wherein the fastening device comprises a plurality of radial extensions on the cap and a circumferential groove within the recess of the cover disk for receiving the extensions.

6. The sliver opening device according to claim 3, wherein the cap is an injection-molded part.

7. The sliver opening device according to claim 3, wherein the cap is a die-cast part.

8. The sliver opening device according to claim 3, wherein the cap has an indicating means for enabling the operating state of the opening cylinder to be recognized.

9. The sliver opening device according to claim 3, wherein the cap has a central bore.

* * * * *